US006866479B2

(12) United States Patent
Ishizaka et al.

(10) Patent No.: US 6,866,479 B2
(45) Date of Patent: Mar. 15, 2005

(54) EXHAUST DIFFUSER FOR AXIAL-FLOW TURBINE

(75) Inventors: Kouichi Ishizaka, Hyogo-ken (JP); Masanori Yuri, Hyogo-ken (JP); Susumu Wakazono, Hyogo-ken (JP); Ronald Takahashi, Miami, FL (US)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 5 days.

(21) Appl. No.: 10/438,866

(22) Filed: May 16, 2003

(65) Prior Publication Data

US 2004/0228726 A1 Nov. 18, 2004

(51) Int. Cl.[7] ..... F01D 9/02

(52) U.S. Cl. ..... 415/209.1; 415/211.2; 415/220; 415/221

(58) Field of Search ..... 415/208.2, 209.1, 415/211.2, 220, 221

(56) References Cited

U.S. PATENT DOCUMENTS 5,338,155 A * 8/1994 Kreitmeier ..... 415/211.2
5,813,828 A * 9/1998 Norris ..... 415/115

* cited by examiner

*Primary Examiner*—Ninh H. Nguyen
(74) *Attorney, Agent, or Firm*—Birch, Stewart, Kolasch & Birch, LLP

(57) ABSTRACT

An axial-flow turbine has an exhaust diffuser including a hub-side tube and a tip-side tube. In the exhaust diffuser, front struts and rear struts are placed to cross a flow of working fluid. A wake generated behind the front strut diverts from the rear strut and passes through a gap between a pair of the rear struts. Otherwise, a wake generated behind the front strut hits against the front face of the rear strut. The front struts are equal to or multiple of the rear struts in number.

12 Claims, 11 Drawing Sheets

EXHAUST DIFFUSER FOR AXIAL-FLOW TURBINE

BACKGROUND OF THE INVENTION

1. Field of the Invention

The present invention relates to an exhaust diffuser for an axial-flow turbine.

2. Description of the Prior Art

In an axial-flow turbine, working fluid that has come out of the last stage of rotating blades is exhausted through an exhaust diffuser. FIG. 12 is a schematic axial cross section of a part of an axial-flow turbine 1 showing the positional relationship between the rotating blades and the exhaust diffuser. The axial-flow turbine 1 is a gas turbine having a turbine casing 10 where a plurality of blade rows/stages, each of which consists of stationary vanes 11 and rotating blades 12, are installed. The rotating blades 12 are installed to a rotor 13, and the rear end of the rotor 13 is supported by a bearing (journal bearing) 15 in a bearing housing 14. The bearing housing 14 is supported by a plurality of struts 20 which cross the flow of the working fluid in radial direction so that the bearing housing 14 is concentric with the center of the turbine casing 10. The term "strut" herein means a structure including a supporting member and a fairing that covers the supporting member to reduce the resistance against the fluid.

The arrow F in FIG. 12 shows the flow of the working fluid. The working fluid flowing out of the rotating blades 12 in the last stage is exhausted through an exhaust diffuser 16. The exhaust diffuser 16 consists of a hub-side tube 17 and a tip-side tube 18 concentrically placed with each other to form an annular flow passageway in between. The hub-side tube 17 has a cylindrical form while the tip-side tube 18 has a truncated conical shape whose diameter becomes larger toward the downstream side. Therefore, the cross-sectional area of the flow passageway in the exhaust diffuser 16 increases from the upstream side to the downstream side, making a so-called conical diffuser. The struts 20 maintain the shape of the annular flow passageway by keeping the gap between the hub-side tube 17 and the tip-side tube 18 and supporting these tubes in the turbine casing 10.

Examples of the struts or the fairings covering them can be seen in the Japanese Patent Application Laid-Open No. 2002-5096 or in the Japanese Patent Application Published No. H6-3145.

A gas turbine 1 as shown in FIG. 12 needs to be provided with a large and long exhaust diffuser 16. In order to construct such a large and long diffuser 16, the struts are installed at both the upstream and the downstream sides. The struts 20 shown in FIG. 12 are disposed at the upstream side and will be referred to as "front struts" hereinafter. The struts disposed at the downstream side (outside of the range of FIG. 12) will be referred to as "rear struts" hereinafter.

Although struts are indispensable elements to compose the exhaust diffuser 16, they inevitably cause loss in the exhaust flow. This will be explained by referring to FIG. 13 and the following.

FIGS. 13 through 15 are schematic cross sections of the exhaust diffuser 16. FIG. 13 shows the view of the rear struts 21 seen from the front struts 20. FIG. 14 is a cross section shown at the location of the front struts 20, and FIG. 15 is a cross section shown at the location of the rear struts 21. In these figures, double lines indicate the front struts 20 and thick solid lines indicate the rear struts 21. The front struts 20 are tangential struts and there are six of them. The rear struts 21 are radial struts and there are three of them.

When the exhaust steam flows through the exhaust diffuser 16, a wake occurs behind each of the front struts 20. Various effects are encountered, depending on the relationship between the wake and the rear struts 21.

Like as FIG. 15, FIGS. 16 through 19 are also schematic cross sections of the exhaust diffuser 16 shown at the location of the rear struts 21. These figures show the results of simulations of the exhaust flow separation at various phase angles (i.e. offset angles in the axial-flow direction) of the rear struts 21 relative to the front struts 20.

FIG. 16 shows the result of a simulation performed with the rear struts 21 placed at a phase angle of zero degree relative to the front struts 20. Separation of the exhaust flow occurs on the side surfaces of the rear struts 21, thus deteriorating the exhaust performance.

FIG. 17 shows the result of a simulation performed with the rear struts 21 placed at a phase angle of minus 7.5 degrees relative to the front struts 20. Separation of the exhaust flow occurs on the inner surface of the tip-side tube 18, resulting in deterioration in the exhaust performance. The degree of the deterioration in the exhaust performance here is far greater than in the case of the simulation performed at zero-degree phase angle.

FIG. 18 shows the result of a simulation performed with the rear struts 21 placed at a phase angle of 225 degrees relative to the front struts 20. Separation of the exhaust flow occurs on the outer surface of the hub-side tube 17, thus deteriorating the exhaust performance. The degree of the deterioration in the exhaust performance here is approximately the same as in the case of the simulation performed at a phase angle of zero degree.

Though not visualized in a figure, around a phase angle of 350 degrees, there is a point where the exhaust performance gets extremely deteriorated.

FIG. 19 shows the result of a simulation performed with the rear struts 21 placed at a phase angle of 135 degrees relative to the front struts 20. Separation of the exhaust flow scarcely occurs and the degree of deterioration in the exhaust performance is minor.

SUMMARY OF THE INVENTION

It is the principal object of the present invention to modify the structure and configuration of the struts on the basis of the above knowledge to improve the performance of the exhaust diffuser.

To achieve the above-mentioned object, in accordance with the present invention, in an exhaust diffuser for an axial-flow turbine, wherein the exhaust diffuser includes front struts and rear struts all of which are placed in an exhaust flow of working fluid, the front struts and the rear struts are placed in such a manner that wakes generated behind the front struts divert from the rear struts and pass through a gap between a pair of the rear struts. In this construction, the wake scarcely causes separation on the side surfaces of the rear struts This helps reduce deterioration in the exhaust performance In accordance with the present invention, in an exhaust diffuser for an axial-flow turbine, wherein the exhaust diffuser includes front struts and rear struts all of which are placed in an exhaust flow of working fluid, the front struts and the rear struts are placed in such a manner that wakes generated behind the front struts hit against the front faces of the rear struts. In this construction, although the wake causes separation on the side surface of the rear strut, the degree of deterioration in the exhaust performance is relatively small.

In accordance with the present invention, in the above exhaust diffuser, the front struts and rear struts are placed in such a manner that wakes generated behind the front struts pass through a gaps between a pair of the rear struts, and the number of the front struts is equal to or multiple of the number of the rear struts. This construction makes it easier to place any of the rear struts in such a manner that the wake passes through the gap between the rear struts.

In accordance with the present invention, in the above exhaust diffuser, the front struts and rear struts placed in such a manner that wakes generated behind the front struts hit against fronts of the rear struts, and the number of the front struts is equal to or multiple of the number of the rear struts. This construction makes it easier to place any of the rear struts in such a manner that the wake hits against the front of the rear strut.

In accordance with the present invention, in an exhaust diffuser for an axial-flow turbine, wherein the exhaust diffuser includes front struts and rear struts all of which are placed in an exhaust flow of working fluid, either or both of the front struts and the rear struts have their hub-side portions shifted toward upstream, compared with the tip-side portions. This construction makes it possible to control the radial distribution of the exhaust flow in the exhaust diffuser and restrain the separation of the exhaust flow on the hub side.

In accordance with the present invention, in an exhaust diffuser for an axial-flow turbine, wherein the exhaust diffuser includes front struts and rear struts all of which are placed in an exhaust flow of working fluid, either or both of the front struts and the rear struts have their tip-side portions shifted toward upstream, compared with the hub-side portions. This construction makes it possible to control the radial distribution of the exhaust flow in the exhaust diffuser and restrain the separation of the exhaust flow on the tip side.

In accordance with the present invention, in an exhaust diffuser for an axial-flow turbine, wherein the exhaust diffuser includes front struts and rear struts all of which are placed in an exhaust flow of working fluid, either or both of the front struts and the rear struts have their middle portions shifted toward downstream side, compared with their hub-side and tip-side portions. This construction makes it possible to control the radial distribution of the exhaust flow in the exhaust diffuser and restrain the separation of the exhaust flow on both the hub and the tip sides.

In accordance with the present invention, in an exhaust diffuser for an axial-flow turbine, wherein the exhaust diffuser includes front struts and rear struts all of which are placed in an exhaust flow of working fluid, either or both of the front struts and the rear struts have their side silhouettes shaped in such a manner that the cord length is longer on the hub and the tip sides than in the middle portion. This construction makes it possible to control the radial distribution of the exhaust flow in the exhaust diffuser and restrain the separation of the exhaust flow on both the hub and the tip sides.

In accordance with the present invention, in an exhaust diffuser for an axial-flow turbine, wherein the exhaust diffuser includes front struts and rear struts all of which are placed in an exhaust flow of working fluid, either or both of the front struts and rear struts have their side silhouettes shaped in such a manner that the cord length is shorter on the hub and the tip sides than in the middle portion. This construction makes it possible to control the radial distribution of the exhaust flow in the exhaust diffuser and restrain the separation of the exhaust flow on the hub and the tip sides.

In accordance with the present invention, in an exhaust diffuser for an axial-flow turbine, wherein the exhaust diffuser includes front struts and rear struts all of which are placed in an exhaust flow of working fluid, either or both of the front struts and the rear struts have cross sections varying in shape in the radial direction of the exhaust diffuser. This construction makes it possible to control the radial distribution of the exhaust flow in the exhaust diffuser and restrain the separation of the exhaust flow on both the hub and the tip sides.

In accordance with the present invention, in an exhaust diffuser for an axial-flow turbine, wherein the exhaust diffuser includes front struts and rear struts all of which are placed in an exhaust flow of working fluid, either or both of the front struts and the rear struts have front silhouettes shaped in a bow. This construction makes it possible to control the radial distribution of the exhaust flow in the exhaust diffuser and restrain the separation of the exhaust flow on both the hub and the tip sides.

BRIEF DESCRIPTION OF THE DRAWINGS

These and other aims and natures of the present invention, in accordance with the preferred embodiments, are more particularly described in the following detailed description taken in conjunction with the preferred embodiments with reference to the accompanying drawings in which.

DESCRIPTION OF THE PREFERRED EMBODIMENTS

Referring now to FIGS. 1 through 11, embodiments of the present invention will be described hereinafter.

Figure 1:
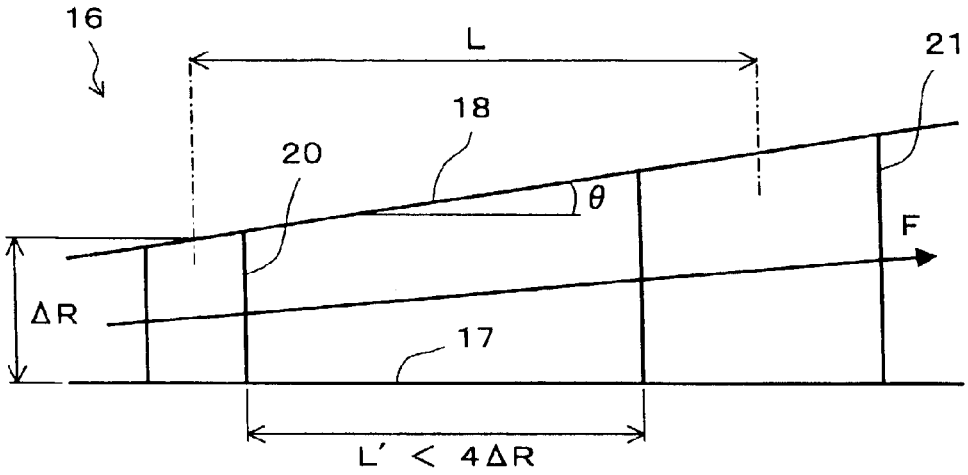
FIG. 1 is a schematic partial axial cross section of the exhaust diffuser in accordance with a first embodiment of the present invention.
Figure 2:
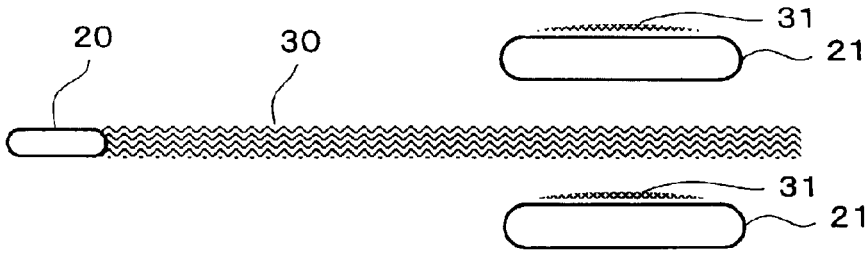
FIG. 2 is a schematic partial cross section showing the arrangement of the struts in the exhaust diffuser in accordance with the first embodiment of the present invention.
Figure 12:
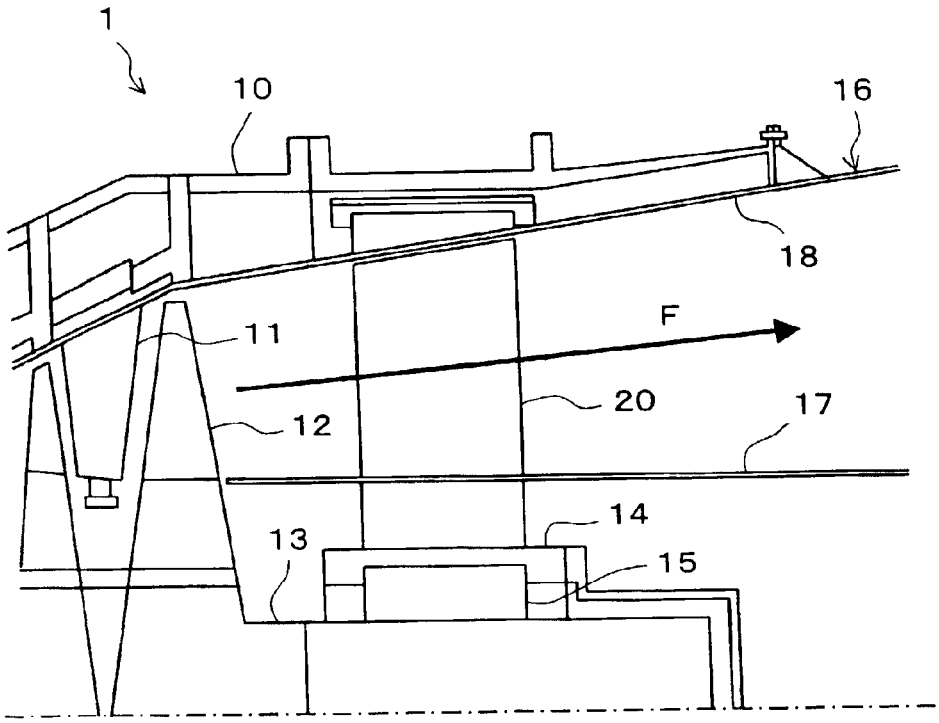
FIG. 12 is a schematic partial axial cross section of an axial-flow turbine.
Figure 13:
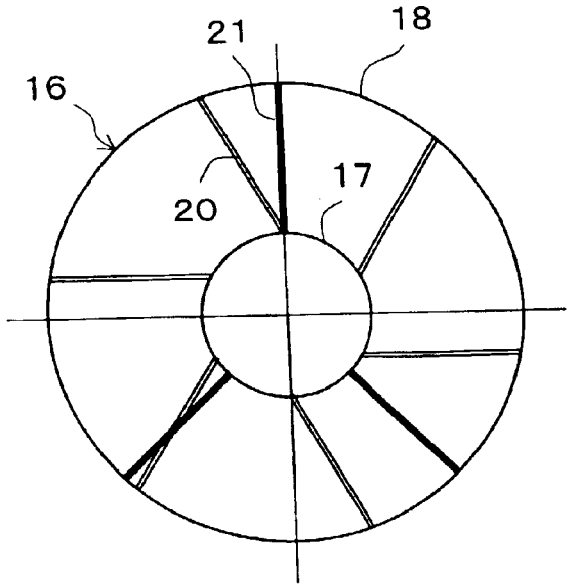
FIG. 13 is a schematic cross section of an exhaust diffuser.
Figure 14:
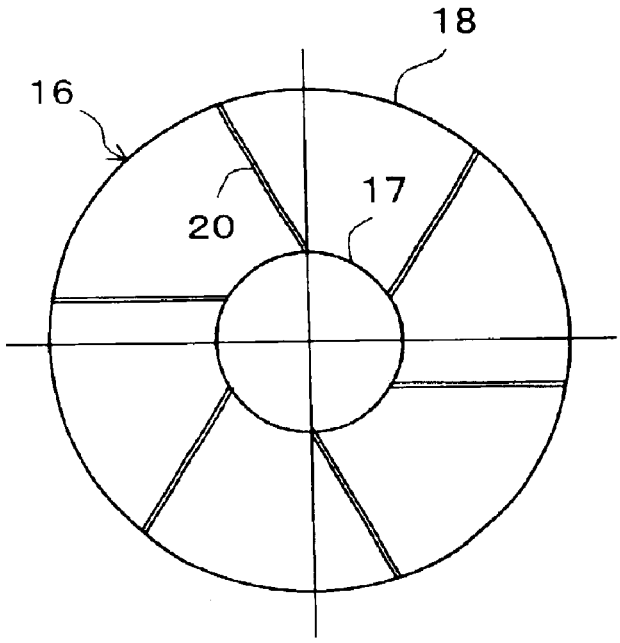
FIG. 14 is a schematic cross section of the exhaust diffuser cut at the front struts.
Figure 15:
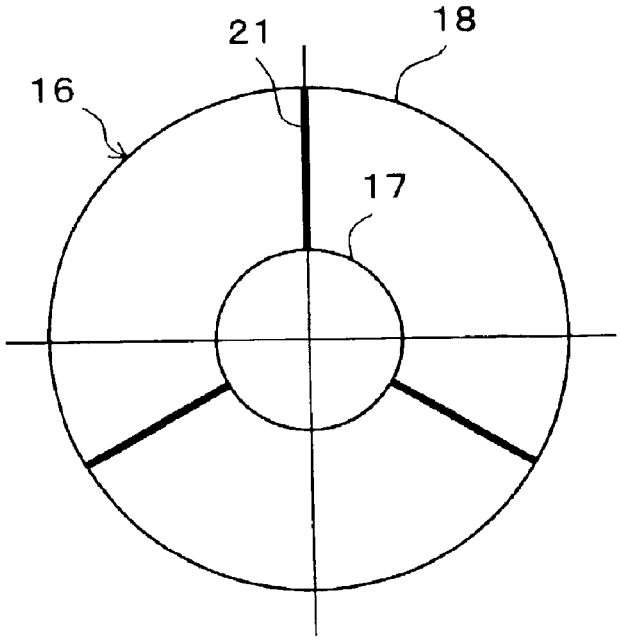
FIG. 15 is a schematic cross section of the exhaust diffuser cut at the rear struts.

FIG. 1 is a schematic partial axial cross section of the exhaust diffuser in accordance with a first embodiment of the present invention. FIG. 2 is a schematic partial cross section showing the arrangement of the struts viewed from a different direction from in FIG. 1. The exhaust diffuser 16 shown in FIG. 1 is a conical diffuser similar to the exhaust diffuser in FIG. 12. A hub-side tube 17 in a cylindrical shape is located concentrically with a tip-side tube 18 in a truncated conical shape, thereby forming an annular flow passageway between them. In the flow passageway, front struts 20 and rear struts 21 are placed axially at an interval in the exhaust diffuser 16.

The distance between the front struts 20 and the rear struts 21 is set by the following formula, where L' is the distance between the rear end(s) of the front struts 20 and the front end(s) of the rear struts 21 and ΔR is the mean height of the front struts 20.

$$L' < 4\Delta R$$

Figure 19:
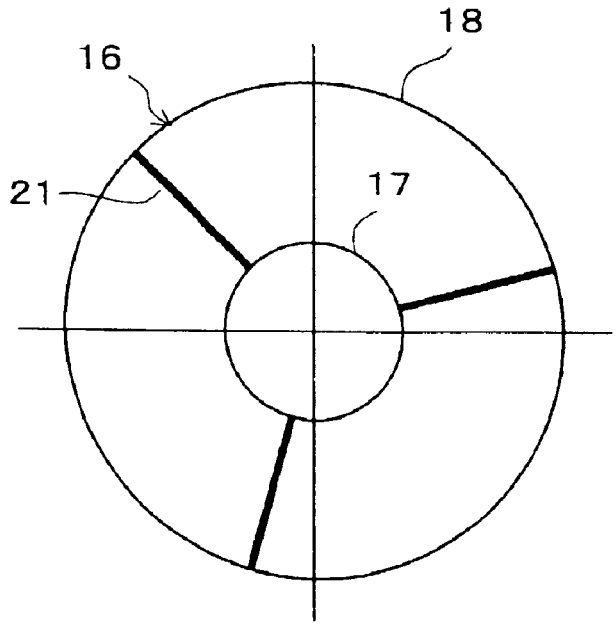
FIG. 19 is a schematic cross section similar to FIG. 16 where the phase angle of the rear strut is changed further than in FIG. 18.

As shown in FIG. 2, the front struts 20 and the rear struts 21 are placed in such a manner that the wake 30 generated behind the front strut 20 diverts from the rear strut 21 and passes through a gap between a pair of the rear struts 21. The state shown in FIG. 2 corresponds to the state of the phase shown in FIG. 19, where the rear struts are placed at a phase angle of 135 degrees relative to the front struts.

In the above-mentioned layout, the wake 30 passes through a gap between a pair of the rear struts 21 without interfering with any of the rear struts 21, and thus scarcely causes the separation of the exhaust flow 31 on the side surface of the rear strut 21. Therefore, the degree of deterioration in the exhaust performance is minor.

The construction of the exhaust diffuser 16 in accordance with the first embodiment is especially effective when it fulfils the following condition, where A1 is the area of the annular flow passageway at the outlet (i.e. rear end) of the front struts 20 and A2 is the area of the annular flow passageway at the outlet (i.e. rear end) of the rear struts 21:

$$A2/A1 > 1.5$$

Or, when the slope angle θ of the tip-side tube 18 (See FIG. 1.) is greater than 6 degrees, the separation of the exhaust flow 31 is prone to occur on the side surfaces of the rear struts 21. By making the wake 30 pass through a gap between a pair of the rear struts 21 without interfering with any of the rear struts 21, the separation of the exhaust flow 31 can be reduced even in the above-mentioned conditions which usually promote the separation of the exhaust flow.

The number of the front struts 20 is equal to or multiple of the number of the rear struts 21. This makes it easier to place any of the rear struts 21 in such a manner that the wake 30 diverts from the rear strut 21 and passes through a gap between a pair of the rear struts 21.

Figure 3:
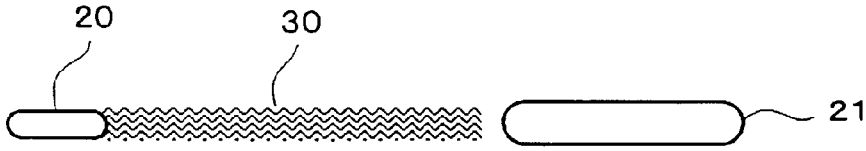
FIG. 3 is a schematic partial cross section showing the arrangement of the struts in the exhaust diffuser in accordance with a second embodiment of the present invention.
Figure 16:
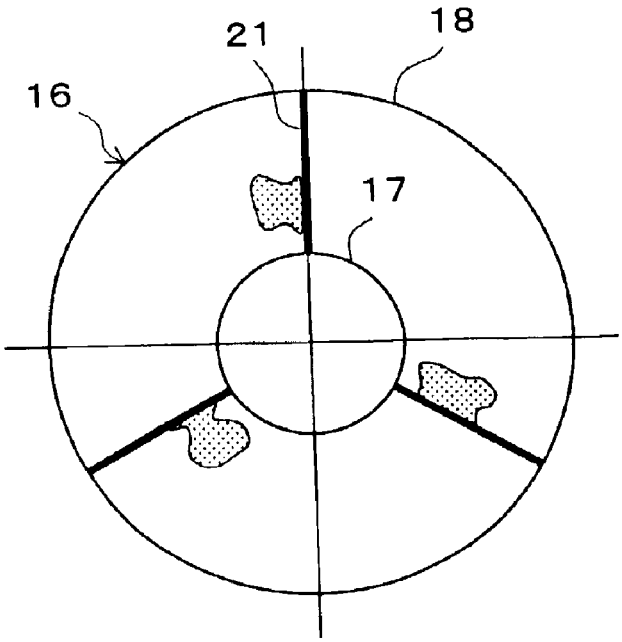
FIG. 16 is a schematic cross section of the exhaust diffuser cut at the rear struts showing the result of simulated exhaust flow.
Figure 17:
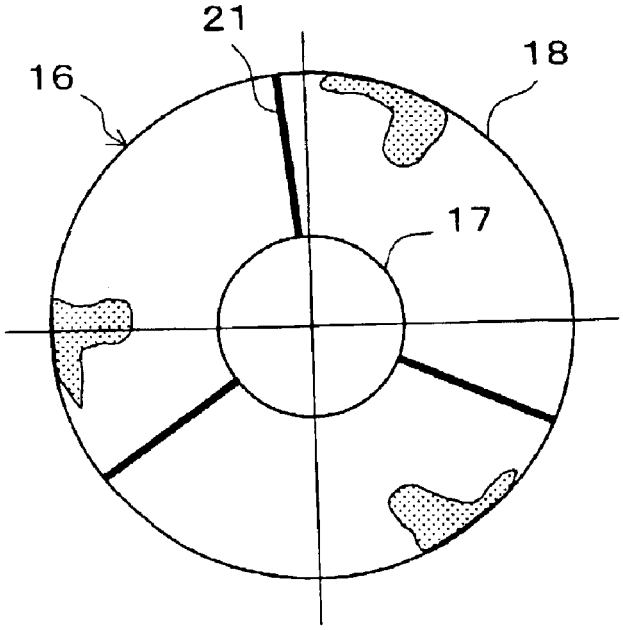
FIG. 17 is a schematic cross section similar to FIG. 16 where the phase angle of the rear strut is changed.
Figure 18:
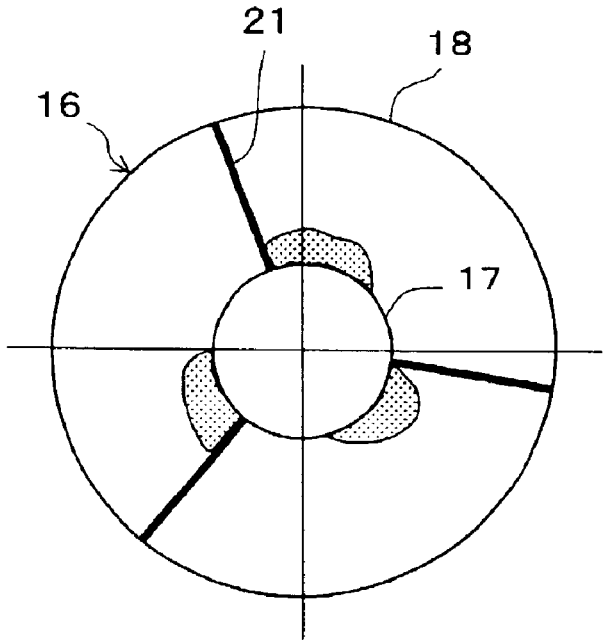
FIG. 18 is a schematic cross section similar to FIG. 16 where the phase angle of the rear struts is changed further than in FIG. 17.

FIG. 3 is a schematic partial cross section similar to FIG. 2 in accordance with a second embodiment of the present invention. In this embodiment, the front struts 20 and the rear struts 21 are placed in such a manner that the wake 30 generated behind the front strut 20 hits against the front face of the rear strut 21. The state shown in FIG. 3 corresponds to the state of the phase shown in FIG. 16, where the phase angle of the rear struts relative to the front struts is zero degree.

In the above layout, although it is inevitable for the wake 30 to produce the separation of the exhaust flow on the side surface of the rear strut 21, the degree of deterioration of the exhaust performance is relatively small, compared with that resulting with any other phase angle.

The construction of the exhaust diffuser 16 in accordance with the second embodiment is especially effective when it fulfils the following condition, where A1 is the area of the annular flow passageway at the outlet (i.e. rear end) of the front struts 20 and A2 is the area of the annular flow passageway at the outlet (i.e. rear end) of the rear struts 21:

$$A2/A1 < 1.5$$

In this condition, the velocity of the exhaust steam passing through the rear strut 21 is increased, making it more likely that the exhaust flow separates from the side surface of the rear strut 21. By making the wake 30 hit against the front face of the rear strut 21, the separation of the exhaust flow is reduced despite the above-mentioned condition under which the separation of the exhaust flow is prone to occur.

The number of the front struts 20 is equal to or multiple of the number of the rear struts 21. This makes it easier to place any of the rear struts 21 in such a manner that the wake 30 hits against the front face of the rear strut 21.

Figure 4:
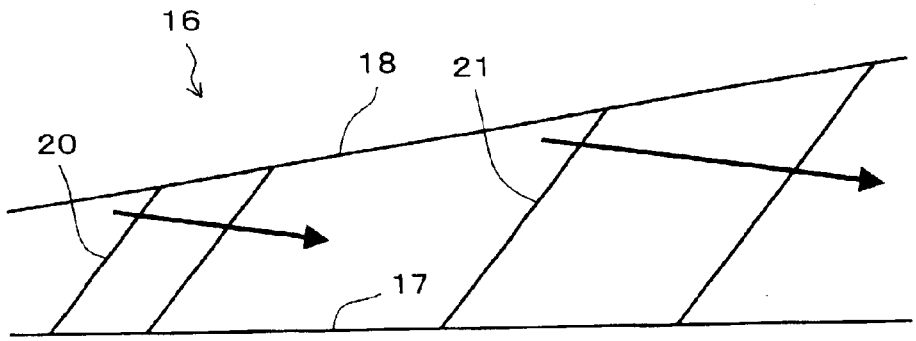
FIG. 4 is a schematic partial axial cross section of the exhaust diffuser in accordance with a third embodiment of the present invention.

FIG. 4 is a schematic partial cross section of the exhaust diffuser in accordance with a third embodiment of the present invention. In this embodiment, the front struts 20 have their hub-side portions shifted toward upstream side, compared with their tip-side portions. Similarly, the rear struts 21 have their hub-side portions shifted toward upstream side, compared with their tip-side portions.

The above-mentioned construction makes it possible to control the radial distribution of the exhaust flow in the exhaust diffuser 16 and restrain the separation of the exhaust flow on the hub side.

In FIG. 4, both the front struts 20 and the rear struts 21 have their hub-side portions shifted toward upstream side, compared with their tip-side portions. Even when this layout is applied only to either of the front struts 20 and the rear struts 21, the desired effect is brought about to a certain degree.

Figure 5:
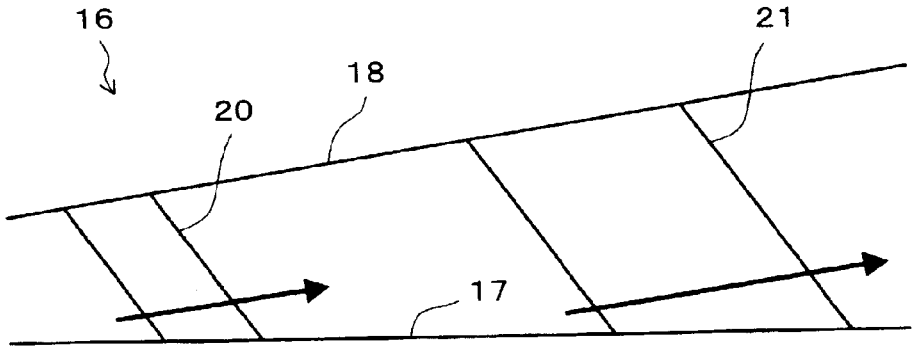
FIG. 5 is a schematic partial axial cross section of the exhaust diffuser in accordance with a fourth embodiment of the present invention.

FIG. 5 is a schematic partial cross section of the exhaust diffuser in accordance with a fourth embodiment of the present invention. Here, the front struts 20 have their tip-side portions shifted toward upstream side, compared with their hub-side portions. Similarly, the rear struts 21 have their tip-side portions shifted toward upstream side, compared with their hub-side portions.

The construction mentioned above makes it possible to control the radial distribution of the exhaust flow in the exhaust diffuser 16 and restrain the separation of the exhaust flow on the tip side.

In FIG. 5, both the front struts 20 and the rear struts 21 have their tip-side portions shifted toward upstream side, compared with their hub-side portions. Even when this layout is applied only to either of the front struts 20 and the rear struts 21, the desired effect is achieved to a certain degree.

Figure 6:
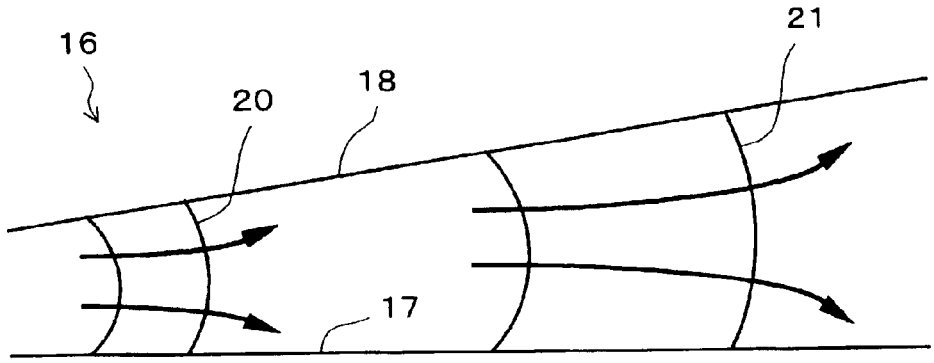
FIG. 6 is a schematic partial axial cross section of the exhaust diffuser in accordance with a fifth embodiment of the present invention.

FIG. 6 is a schematic partial cross section of the exhaust diffuser in accordance with a fifth embodiment of the present invention. Here, the front struts 20 have their middle portions shifted toward downstream side, compared with their hub-side and tip-side portions. As a result, the side silhouettes of the front struts 20 are curved (skewed). Similarly, the rear struts 21 have their middle portions shifted toward downstream side, compared with their hub-side and tip-side portions, making the side silhouettes of the rear struts 21 curved/skewed.

The above-mentioned construction makes it possible to control the radial distribution of the exhaust flow in the exhaust diffuser 16 and restrain the separation of the exhaust flow on the hub and tip sides.

In FIG. 6, both the front struts 20 and the rear struts 21 have their middle portions shifted toward downstream side, compared with their hub-side and tip-side portions. However, even when this layout is applied only to either of the front struts 20 and the rear struts 21, the desired effect is brought about to a certain degree.

Figure 7:
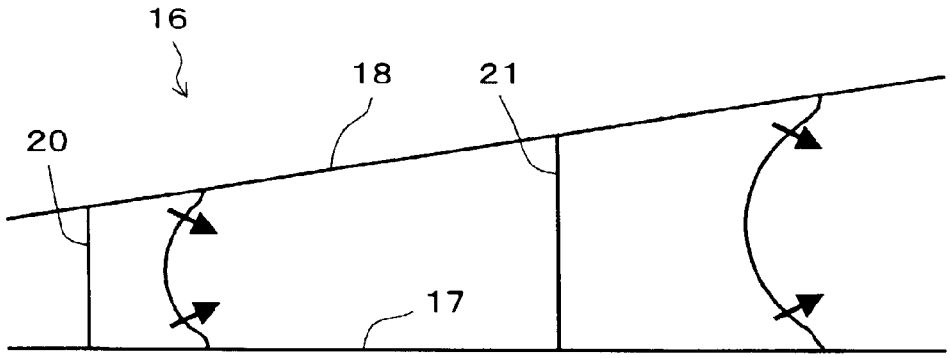
FIG. 7 is a schematic partial axial cross section of the exhaust diffuser in accordance with a sixth embodiment of the present invention.

FIG. 7 is a schematic cross section of the exhaust diffuser in accordance with a sixth embodiment of the present invention. In this construction, the front struts 20 have their side silhouettes shaped in such a manner that the cord length is longer on the hub and tip sides than in the middle portion. Note that the cord length corresponds to the horizontal length of the side silhouette of each front strut 20. Similarly, the rear struts 21 have their side silhouettes shaped in such a manner that the cord length is longer on the hub and the tip sides than in the middle portion. The difference in the cord length should be 10 percent or more of the mean cord length.

The above-mentioned construction makes it possible to control the radial distribution of the exhaust flow in the exhaust diffuser 16 and restrain the separation of the exhaust flow on the hub and the tip sides.

In FIG. 7, both the front struts 20 and the rear struts 21 are shaped in such a manner that the cord length is longer on the hub and the tip sides than in the middle portion. Even when this construction is applied only to either of the front struts 20 and the rear struts 21, the desired effect is achieved to a certain degree.

Figure 8:
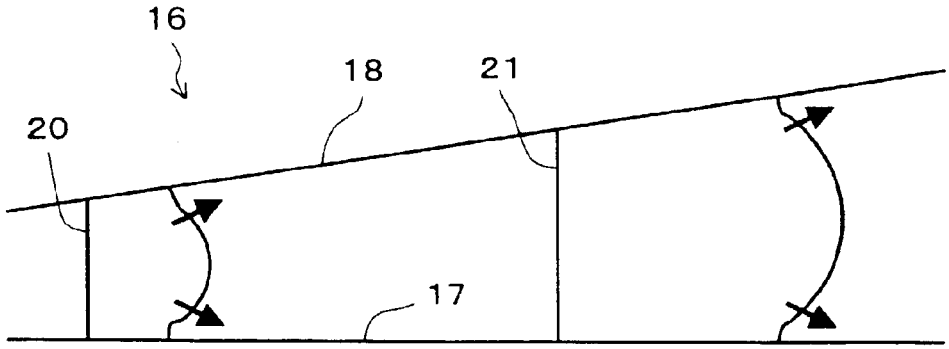
FIG. 8 is a schematic partial axial cross section of the exhaust diffuser in accordance with a seventh embodiment of the present invention.

FIG. 8 is a schematic cross section of the exhaust diffuser in accordance with a seventh embodiment of the present invention. In this construction, the front struts 20 have their side silhouettes shaped in such a manner that the cord length is shorter on the hub and the tip sides than in the middle portion. Similarly, the rear struts 21 have the side silhouettes shaped in such a manner that the cord length is shorter on the hub and the tip sides than in the middle portion. The difference in the cord length should be 10 percent or more of the mean length.

The above-mentioned construction makes it possible to control the radial distribution of the exhaust flow in the exhaust diffuser 16 and restrain the separation of the exhaust flow on the hub and the tip sides.

In FIG. 8, both the front struts 20 and the rear struts 21 are shaped in such a manner that the cord length is shorter on the hub and the tip sides than in the middle portion. Even when this construction is applied only to either of the front struts 20 and the rear struts 21, the desired effect is achieved to a certain degree.

Figure 9:
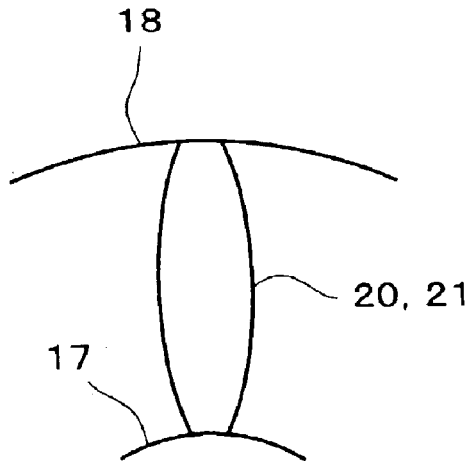
FIG. 9 is a front view of a strut in accordance with an eighth embodiment of the present invention.

FIG. 9 is a front view of one of the struts in accordance with an eighth embodiment of the present invention. In the eighth embodiment, a strut has cross sections varying in shape in the radial direction of the exhaust diffuser 16. In FIG. 9, the strut is thicker in the middle portion than on the hub and the tip sides. This helps control the radial distribution of the exhaust flow in the exhaust diffuser 16 and restrain the separation of the exhaust flow on the hub and the tip sides. This construction can be applied to both or either of the front struts 20 and the rear struts 21.

Figure 10:
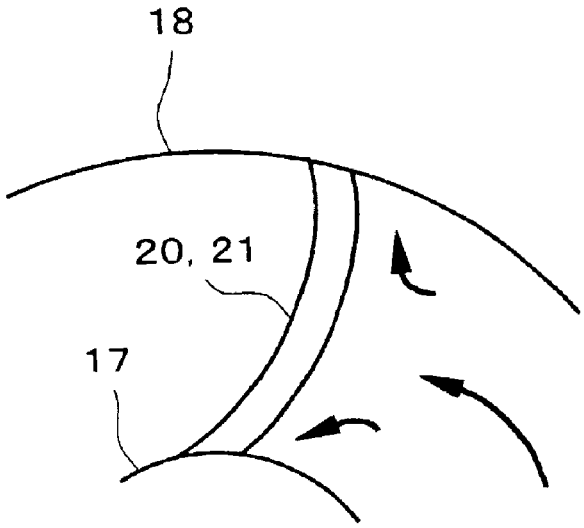
FIG. 10 is a front view of a strut in accordance with a ninth embodiment of the present invention.

FIG. 10 is a front view of one of the struts in accordance with a ninth embodiment of the present invention. In the ninth embodiment, the front silhouette of a strut has a bowed or curved shape. This bowed shape of the strut makes it possible to control the radial distribution of the exhaust flow in the exhaust diffuser 16 and restrain the separation of the exhaust flow on the hub and the tip sides. This construction can be applied to both or either of the front struts 20 and the rear struts 21.

The relationship among these embodiments is as follows. The third through the seventh embodiments can each be practiced in combination with either the first embodiment or the second embodiment. The eighth embodiment and the ninth embodiment can each be combined with one of the first through the seventh embodiments. In addition, it is possible to further combine the eighth or the ninth embodiment with a combination of one of the third through the seventh embodiments with the first or the second embodiment. It is also possible to combine the eighth and the ninth embodiments. Moreover, the combination of the eighth and the ninth embodiments can be possible. The combination of the eighth and the ninth embodiments can be combined with another embodiment or with a combination of other embodiments.

Figure 11:
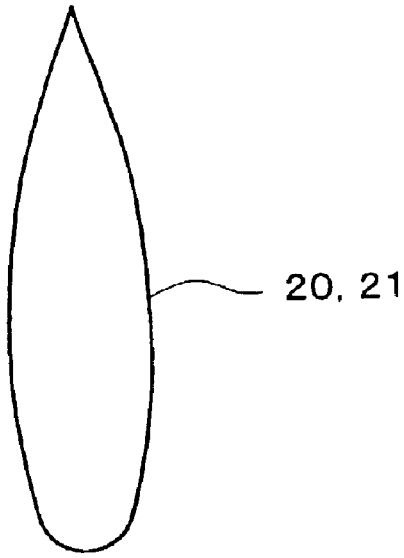
FIG. 11 is a cross section showing a modified structure of a strut.

The shape of the cross section of the front struts 20 and the rear struts 21 may be an elongate circle as shown in FIG. 2 or FIG. 3 or it may take an airfoil shape as shown in FIG. 11.

While there have been described herein what are to be considered preferred embodiments of the present invention, other modifications and variations of the invention are possible to be practiced, provided all such modifications fall within the spirit and scope of the invention.

What is claimed is:

1. An exhaust diffuser for an axial-flow turbine, including front struts and rear struts all of which are placed in an exhaust flow of working fluid, wherein an annular flow passageway through which the exhaust flow is passed has an area A1 at an exit of said front stunts and an area A2 at an exit of said rear struts, the areas A1 and A2 fulfilling a relationship $$A2/A11.5,$$

and said front struts and rear struts are placed in such a manner that wakes generated behind said front struts divert from said rear struts and pass through a gap between a pair of said rear struts.

2. An exhaust diffuser as claimed in claim 1, wherein the number of said front struts is equal to or a multiple of the number of said rear struts.

3. An exhaust diffuser, as claimed in claim 1, wherein either or both of said front struts and rear struts have tip-side portions thereof shifted toward an upstream side, compared with hub-side portions thereof.

4. An exhaust diffuser for an axial-flow turbine, including front struts and rear struts all of which are placed in an exhaust flow of working fluid, wherein an annular flow passageway through which the exhaust flow is passed has an area A1 at an exit of said front struts and an area A2 at an exit of said rear struts, the areas A1 and A2 fulfilling a relationship $$A2/A1<1.5,$$

and said front struts and rear struts are placed in such a manner that wakes generated behind said front struts hit against front faces of said rear struts.

5. An exhaust diffuser as claimed in claim 4, wherein the number of said front struts is equal to or a multiple of the number of said rear struts.

6. An exhaust diffuser as claimed in claim 4, wherein either or both of said front struts and rear struts have tip-side portions thereof shifted toward an upstream side, compared with hub-side portions thereof.

7. An exhaust diffuser for an axial-flow turbine, including front struts and rear struts all of which are placed in an exhaust flow of working fluid, wherein either or both of said front struts and rear struts have hub-side portions thereof shifted toward an upstream side, compared with tip-side portions thereof.

8. An exhaust diffuser for an axial-flow turbine, including front struts and rear struts all of which are placed in an exhaust flow of working fluid, wherein either or both of said front struts and rear struts have middle portion thereof shifted toward a downstream side, compared with hub-side and tip-side portions thereof.

9. An exhaust diffuser for an axial-flow turbine, including front struts and rear struts all of which are placed in an exhaust flow of working fluid, wherein either or both of said front struts and rear struts have side silhouettes shaped in such a manner that a cord length is longer on hub and tip sides than in a middle portion.

10. An exhaust diffuser for an axial-flow turbine, including front struts and rear struts all of which are placed in an exhaust flow of working fluid, wherein either or both of said front struts and rear struts have side silhouettes shaped in such a manner that a cord length is shorter on hub and tip sides than in a middle portion.

11. An exhaust diffuser for an axial-flow turbine, including front struts and rear struts all of which are placed in an exhaust flow of working fluid, wherein either or both of said front struts and rear struts are thicker in middle portions thereof and thinner on hub-side and tip-side portions as thereof as measured in a radial direction of said exhaust diffuser.

12. An exhaust diffuser for an axial-flow turbine, including front struts and rear struts all of which are placed in an exhaust flow of working fluid, wherein either or both of said front struts and rear struts have bow-shaped front silhouettes on both sides of said struts viewed from a front face thereof.

* * * * *